US008058786B2

(12) United States Patent
Below

(10) Patent No.: US 8,058,786 B2
(45) Date of Patent: Nov. 15, 2011

(54) DIELECTRIC ENHANCED PARTIAL THREAD SPARK PLUG

(75) Inventor: Matthew B. Below, Findlay, OH (US)

(73) Assignee: Fram Group IP LLC, Danbury, CT (US)

( * ) Notice: Subject to any disclaimer, the term of this patent is extended or adjusted under 35 U.S.C. 154(b) by 369 days.

(21) Appl. No.: 12/361,028

(22) Filed: Jan. 28, 2009

(65) Prior Publication Data

US 2009/0189505 A1 Jul. 30, 2009

Related U.S. Application Data

(60) Provisional application No. 61/024,045, filed on Jan. 28, 2008.

(51) Int. Cl.
*H01T 13/20* (2006.01)

(52) U.S. Cl. ..... 313/143

(58) Field of Classification Search ..... 313/118–145, 313/238; 140/174.5; 445/7; 123/143 R, 123/146.5 R, 169 R, 169 EL, 169 P, 260, 123/280; 29/33 M, 33 N, 842, 844, 847, 29/888.01

See application file for complete search history.

(56) References Cited

U.S. PATENT DOCUMENTS

| | | | | |
|---|---|---|---|---|
| 5,091,672 | A | 2/1992 | Below | |
| 5,697,334 | A | 12/1997 | Below | |
| 5,918,571 | A | 7/1999 | Below | |
| 6,104,130 | A | 8/2000 | Below | |
| 6,204,594 | B1 * | 3/2001 | Ingham | 313/141 |
| 7,172,483 | B2 * | 2/2007 | Ando et al. | 445/7 |
| 2002/0000765 | A1 * | 1/2002 | Suzuki | 313/141 |
| 2002/0024160 | A1 | 2/2002 | Sugimoto | |
| 2002/0057044 | A1 * | 5/2002 | Klett et al. | 313/140 |
| 2005/0168120 | A1 | 8/2005 | Kanao et al. | |
| 2008/0061670 | A1 * | 3/2008 | Nakayama et al. | 313/143 |
| 2009/0102345 | A1 | 4/2009 | Hotta et al. | |

FOREIGN PATENT DOCUMENTS

| | | | |
|---|---|---|---|
| JP | 6333664 | A | 12/1994 |
| JP | 200759078 | A | 3/2007 |
| JP | 200759365 | A | 3/2007 |

OTHER PUBLICATIONS

International Search Report—PCT/US2009/032214 dated Sep. 7, 2009.

Written Opinion of the International Searching Authority—PCT/US2009/032214 dated Sep. 7, 2009.

* cited by examiner

*Primary Examiner* — Peter Macchiarolo
(74) *Attorney, Agent, or Firm* — Cantor Colburn, LLP

(57) ABSTRACT

A small diameter spark plug configuration is provided, the configuration has been found to provide additional volume for the insulator member. That is, by limiting the overall number of threads on the intermediate portion along with a limit of the overall diameter of the spark plug, additional volume of insulator material may be achieved in an interior cavity of a metal shell of the spark plug. This additional volume enables a portion of the insulator member to have a larger diameter and hence greater material thickness. The larger diameter of the insulator provides enhanced dielectric properties and protects internal components of the spark plug from high combustion chamber temperatures while simultaneously providing a robust attachment of the spark plug with an engine head.

15 Claims, 3 Drawing Sheets

DIELECTRIC ENHANCED PARTIAL THREAD SPARK PLUG

CROSS REFERENCE TO RELATED APPLICATION

This application claims the benefit of the following U.S. Provisional Patent application Ser. No. 61/024,045 filed Jan. 28, 2008, the contents of which are incorporated herein by reference thereto.

FIELD OF THE INVENTION

Exemplary embodiments of the present invention relate to spark plugs and, more particularly, to a small diameter spark plug having an enhanced insulator.

BACKGROUND OF THE INVENTION

In general, spark plugs include an insulating sleeve having a central axial bore through which a center electrode extends. The insulating sleeve is positioned within and secured to a metal shell that serves as a mounting platform/interface to an internal combustion engine. The metal sleeve also supports a ground electrode that is positioned in a particular spaced relationship relative to the central electrode so as to define a spark gap. The spark plug is typically mounted to an engine cylinder head and selectively activated to deliver a spark that ignites a fuel/air mixture in an associated engine cylinder.

Smaller engines, particularly those employed in compact motor vehicles, have minimal available space for engine components. Cylinder spacing, i.e., the space between adjacent cylinders is also minimized to optimize engine size. As a result, spark plugs for smaller engines generally have a small diameter, e.g., in the range of 12 mm. Unfortunately, smaller diameter plugs have less available volume for internal components such as an insulator. As a result, insulator thickness must be reduced.

BRIEF DESCRIPTION OF THE INVENTION

In accordance with one exemplary embodiment of the invention, an enhanced spark plug is provided. The enhanced spark plug has an improved heat resistance. The spark plug includes a metal shell having a main body portion. The main body portion includes a first end, a second end and an intermediate section that collectively define an interior cavity. The intermediate section includes the intermediate section including a first unthreaded zone defining a first diametric portion and a second unthreaded zone adjacent to the first unthreaded zone defining a second diametric portion, the first diametric portion having an inner periphery greater than an inner periphery of the second diametric portion, the metal shell further comprising a third threaded zone adjacent to the second unthreaded zone and a fourth unthreaded zone adjacent the third threaded zone, the third threaded zone defining a third diametric portion having an inner periphery less than the inner periphery of the second diametric portion and the fourth unthreaded zone defining a fourth diametric portion having an inner periphery, the inner periphery of the fourth diametric portion being less than the inner periphery of the third diametric portion, wherein the interior cavity has a stepped configuration defined by the inner periphery of the first, second, third and fourth diametric portions; an insulator disposed in the metal shell, the insulator having a first end portion extending from the first end portion of the metal shell, a second end portion provided at the second end of the metal shell and an intermediate portion being configured to be recessed within the stepped configuration of the interior cavity and the intermediate portion extending between the first end portion and second end portion, the intermediate portion having a first diametric section nested within the first diametric portion and a second diametric section nested within the second diametric portion and a third diametric section nested with the third diametric portion, the first diametric section having a material thickness greater than a material thickness of the second diametric section; a center wire disposed within a central bore extending through the insulator from the first end portion to the second end portion of the insulator, the center wire having a head portion positioned within the second diametric section of the insulator; and a resistor disposed in the central bore of the insulator, the resistor being in electrical communication with the center wire via the head portion and the resistor is located within the first diametric section and the second diametric section of the insulator, wherein a minimum thickness of at least 2.0 mm of the insulator is located between the resistor and the first diametric portion and the second diametric portion of the intermediate section of the metal shell and wherein an outer diameter of the third threaded zone is no greater than 12 mm.

The above described small diameter spark plug configuration has been advantageously found to provide additional volume for the insulator member. That is, by limiting the overall number of threads on the intermediate portion to in one embodiment no more than seven, additional volume of insulator material may be achieved in the interior cavity at the first intermediate portion. This additional volume enables the portion of insulator member, heretofore having a small diameter, to have a larger diameter and hence greater material thickness. The larger diameter of the intermediate portion of the insulator provides enhanced dielectric properties and protects internal components of the spark plug from high combustion chamber temperatures while simultaneously providing a robust attachment with an engine head. Additional objects, features and advantages of the present invention will become more readily apparent from the following detailed description when taken in conjunction with the drawings wherein like reference numerals refer to corresponding parts in the several views.

DETAILED DESCRIPTION OF THE INVENTION

Figure 1:
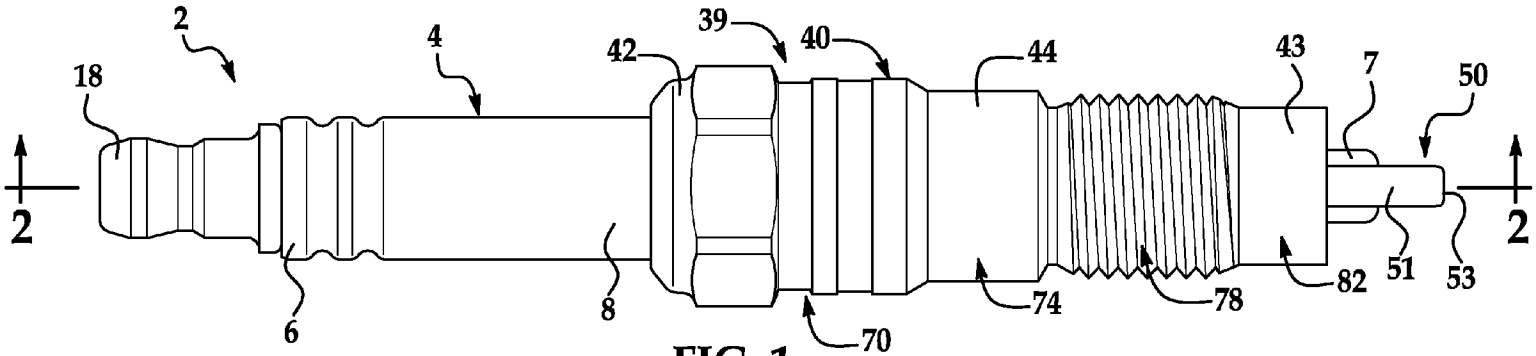
FIG. 1 is an elevational view of an exemplary embodiment of a small diameter spark plug.
Figure 2:
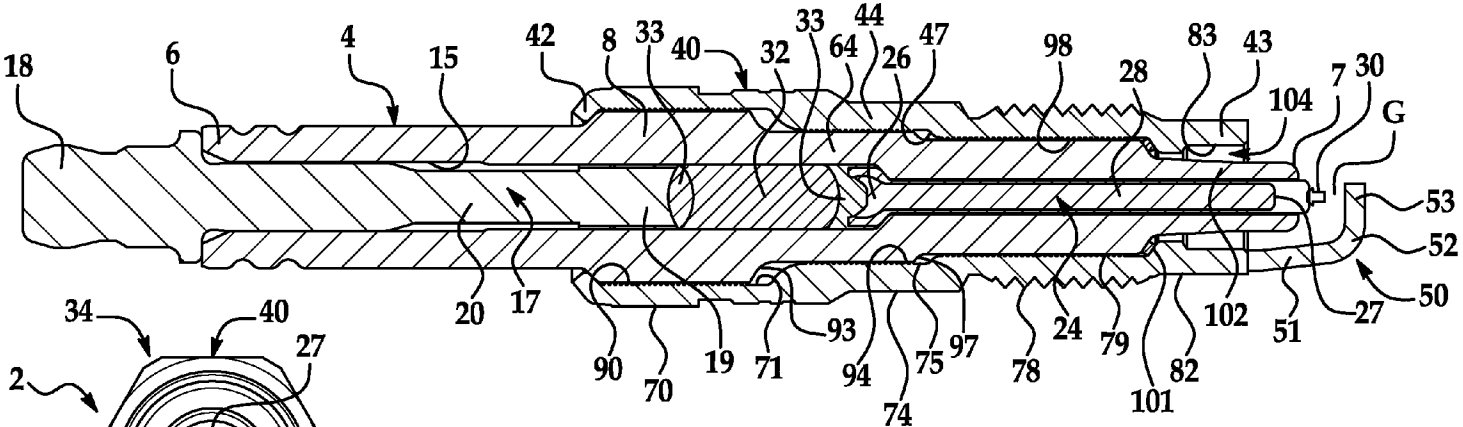
FIG. 2 is a cross-sectional view along lines 2-2 of FIG. 1.
Figure 3:
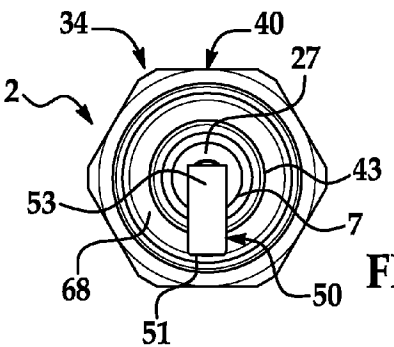
FIG. 3 is an end view of the spark plug of FIG. 1.

With initial reference to FIGS. 1-3, a small diameter spark plug constructed in accordance with an exemplary embodiment of the present invention is indicated generally at 2. Spark plug 2 includes an electrically insulating sleeve or insulator 4 having a first end portion 6, a second end portion 7 and an intermediate portion 8. Insulator 4 includes an axial bore 15 that extends between first and second end portions 6 and 7.

Figure 5:
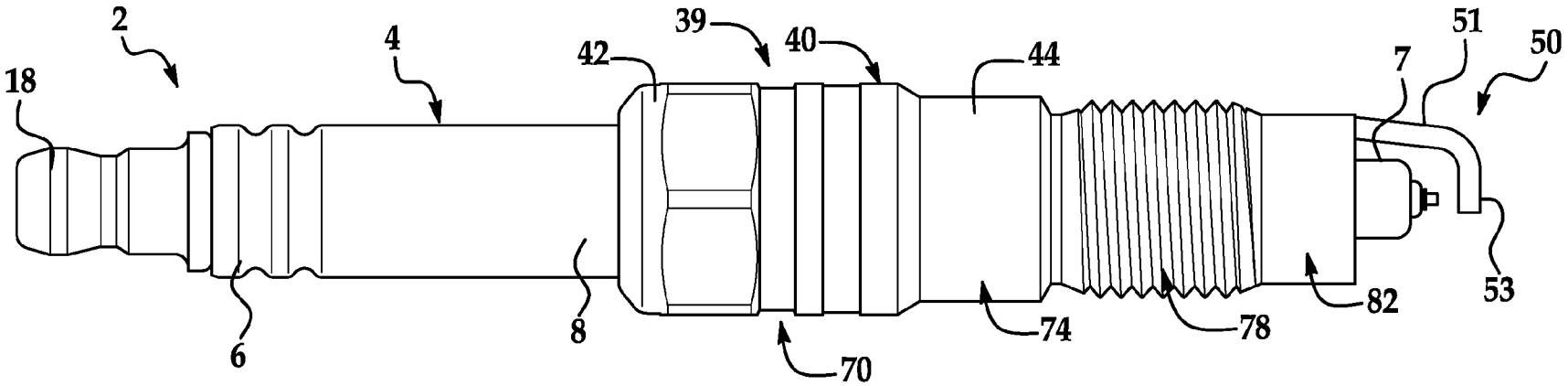
FIG. 5 illustrates view of FIGS. 1-3 with non-limiting exemplary dimensions.

As shown in FIG. 2, spark plug 2 includes a first electrode 17 arranged in an upper portion (not separately labeled) of axial bore 15. First electrode 17 includes a first end or tip section 18 that extends out beyond first end portion 6 of insulator 4 and a second end section 19. The first end section 18 and the second end section 19 are joined together through the intermediate section 20. Spark plug 2 also includes a second electrode or center wire 24 arranged in a lower portion (not separately labeled) of axial bore 15. Second electrode 24 includes a first end section or head portion 26 that extends to a second end section 27 through an intermediate section 28. Second electrode 24 includes a tip portion 30 provided at second end section 27. First and second electrodes 17 and 24 are electrically connected through a resistor 32. In one embodiment, electrodes 17 and 24 are electrically connected to resistor 32 through a conductive glass 33 or equivalents thereof As illustrated, the upper portion of the axial bore has a larger diameter to accommodate the resistor such that a larger diameter resistor can be inserted therein. In other words, the diameter of the resistor is larger than that of the center wire. However and as will be discussed herein the insulator will have a sufficient thickness around the resistor. In one non-limiting exemplary embodiment, the diameter of the resistor is approximately 4.0 mm or within a range defined by 3 to 4.5 mm as illustrated in FIG. 5 wherein the thickness of the insulator surrounding the resistor is at least 2.0 mm. Of course, other ranges are contemplated to be within the scope of exemplary embodiments of the present invention.

Insulator 4 extends, at least in part, into a metal sleeve or shell 39. Metal shell 39 includes a main body 40 having a first end 42, a second end 43 and an intermediate section 44 that collectively define an interior or central cavity 47. Metal shell 39 also includes a ground electrode 50. Ground electrode 50 includes a first segment 51 that extends from second end 43 of main body 40, a second or curved segment 52 and a third segment 53. Third segment 53 is spaced from, and extends generally perpendicular to tip portion 30 so as to define a spark gap 'G'.

Figure 4:
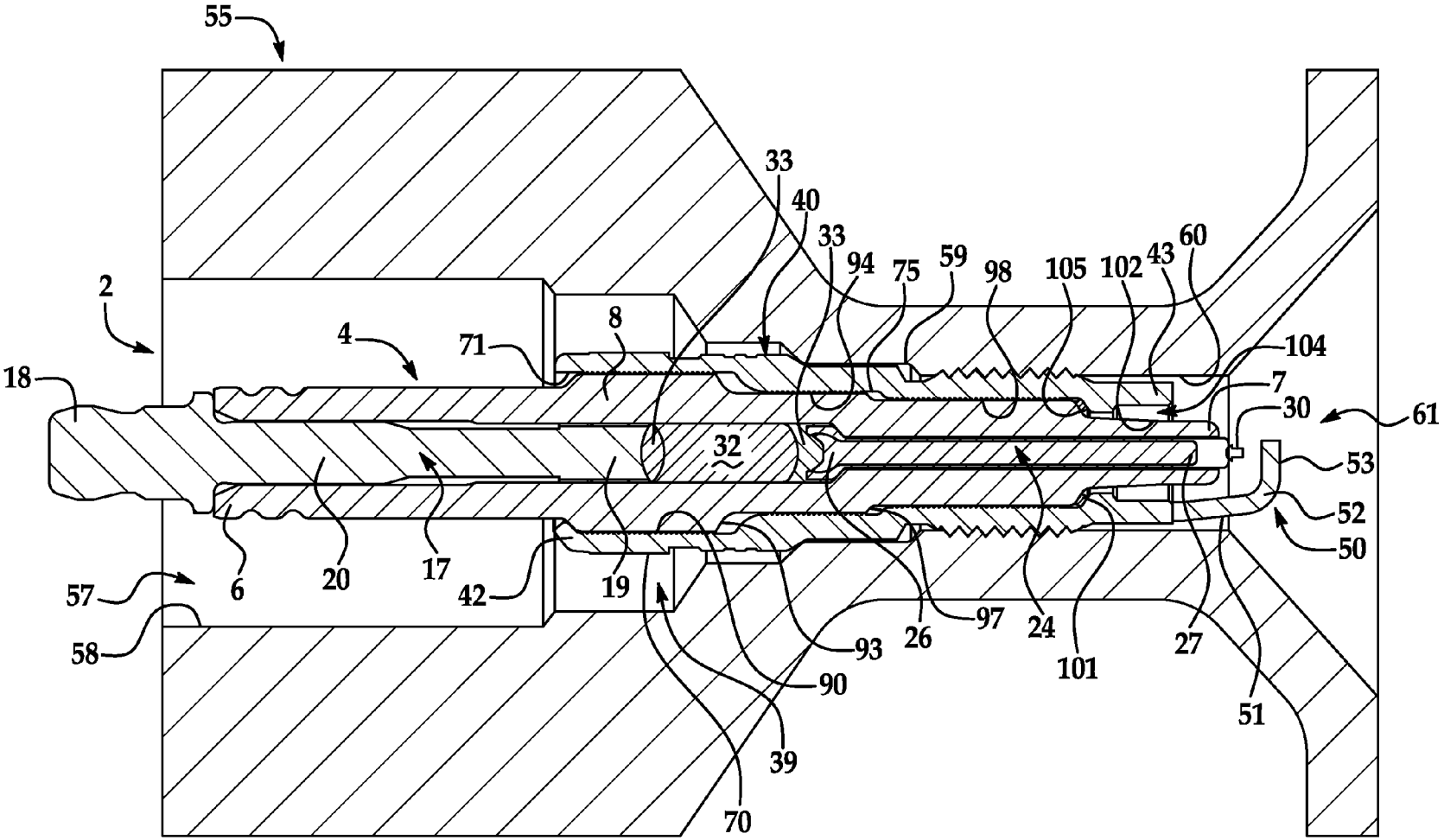
FIG. 4 is a cross-sectional view of an exemplary embodiment of a spark plug mounted to an internal combustion engine.

Metal shell 39 provides a robust mounting arrangement for securing spark plug 2 to an engine cylinder head 55. As shown in FIG. 4, cylinder head 55 includes a spark plug receiving portion 57 having a first end portion 58, an intermediate portion 59 (a portion of which is threaded) and a second end portion 60. Second end portion 60 opens to a recessed area 61 that defines an upper portion of a combustion chamber.

In accordance with one exemplary embodiment of the present invention, intermediate section 44 of metal shell 39 includes a first, unthreaded, zone 70 that defines a first diametric portion 71, a second, unthreaded, zone 74 that defines a second diametric portion 75, a third, threaded zone 78, having a reduced number of threads (e.g. approximately seven threads or less), that defines a third diametric portion 79 and a fourth, unthreaded, zone 82 that defines a fourth diametric portion 83. As shown, the inner periphery of second diametric portion 75 is smaller than first diametric portion 71. The inner periphery of third diametric portion 79 is smaller than second diametric portion 75. The inner periphery of fourth diametric portion 83 is smaller than third diametric portion 79. With this arrangement, central cavity 47 has a stepped profile of gradually reducing inner periphery diameters extending from first zone 70 to fourth zone 82.

In accordance with another exemplary embodiment of the present invention, intermediate portion 8 of insulator 4 is formed with a series of steps that correspond to the stepped profile of central cavity 47. More specifically, intermediate portion 8 includes a first diametric section 90 having a first stepped segment 93 that establishes a second diametric section 94. Second diametric section 94 includes a second stepped segment 97 that establishes a third diametric section 98. Third diametric section 98 includes a third stepped segment 101 that establishes a fourth diametric or tip section 102 of insulator 4. As shown, the outer periphery of second diametric section 94 is smaller than first diametric section 90. The outer periphery of third diametric section 98 is smaller than second diametric section 94. The outer periphery of fourth diametric section 102 is smaller than third diametric section 98. With this arrangement a stepped profile similar to the stepped profile of metal shell 30 is created.

In one exemplary embodiment the outer periphery of the first, second and third section of insulator 4 is substantially equal to the inner periphery of the first, second and third portion of metal shell 39, respectively. Towards that end, first diametric section 90 nests within first diametric portion 71, second diametric section 94 nests within second diametric portion 75 and third diametric section 98 nests within third diametric portion 79. Fourth diametric section 102 is actually spaced from fourth diametric portion 83 so as to form a recess or cup 104 at second end 43 of metal shell 39. Finally, a gasket 105 is provided at third stepped segment 101. Gasket 105 seals central cavity 47 to prevent products of combustion from damaging internal potions of spark plug 2.

A typical 12 mm spark plug having a standard threaded portion has a given range of measurement for internal diameter at the threaded region (e.g. third diametric section 98). By limiting the threaded zone to approximately seven to eleven (7-11) or a non-limiting range of 5-15 threads or fewer, second diametric portion 75 has an increased diameter. For a 12 mm spark plug, the diameter of second diametric portion 75 may be increased over a typical measurement range. It has been found that at a maximum of approximately seven (7) threads and as few as approximately five (5) threads are sufficient to secure spark plug 2 to cylinder head 55 yet still resist loosening due to vibration. Thus, by limiting the overall number of threads on intermediate portion 44, the outer diameter of second zone 74 can be increased which results in a corresponding increase of volume in central cavity 47 at second diametric portion 75. For example, the outer diameter of second zone 74 can be increased to at least 12.07 mm illustrated in FIG. 5. Of course, other dimensions and ranges are considered to be within the scope of exemplary embodiments of the present invention.

The increased volume, i.e., diameter of second diametric portion 75 allows for a corresponding increase in volume, i.e., diameter of second diametric section 94 of insulator 4. That is, second diametric section 94 has a diameter in the range similar to the range of second diametric portion 75. In this manner, the exemplary embodiment of the present invention enables insulator 4 for a 12 mm diameter spark plug to have a dielectric constant approaching that of a larger spark plug, for example a 14 mm diameter spark plug or greater. Accordingly, by increasing the size of second diametric section 94, the dielectric constant of insulator 4 will increase as much as 30% which provides additional protection for resistor 32. For example, a dielectric value of an insulator in a typical 12 mm plug is 31 kV while a dielectric value of a 14 mm plug is 38 kV. However, the exemplary embodiment illustrated in FIGS. 1-5 provides an insulator with an increased dielectric value of approximately 30% from that of a typical 12 mm plug. In addition, by increasing the diameter of second diametric section 94, first and second electrodes 17 and 24 can be made common for a wider ranges of spark plug sizes to reduce manufacturing and inventory cost yet still accommodate multiple heat ranges.

In addition and as illustrated, an exemplary embodiment of the present invention is directed to a spark plug having a multiple stepped depth configuration wherein the spark plug is threaded for a 12 mm opening and a minimum thickness of 2.16 mm is provided around the resistor of the spark plug. Moreover and in one exemplary embodiment, the number of threads in the threaded portion is limited to seven.

At this point it should be appreciated that above described spark plug configuration has been advantageously found to provide additional volume for the insulator. That is, by limiting the overall number of threads on the intermediate portion to no more than approximately seven, additional volume is obtained in the central cavity. This additional volume enables the corresponding portion of the insulator, heretofore having a small diameter, to have a larger diameter. The larger diameter of the intermediate portion of the insulator member provides enhanced dielectric properties and protects internal components of the spark plug from high combustion chamber temperatures while simultaneously providing a robust attachment with an engine head.

One set of non-limiting dimensions of an exemplary spark plug configuration (e.g., 12 mm) are shown in FIG. 5 wherein the dimensions are shown in mm.

Although described with reference to illustrated exemplary embodiments of the present invention, it should be readily understood that various changes and/or modifications can be made to the invention without departing from the spirit thereof For instance, while the small diameter spark plug is shown as having 7 threads, the threaded section can include approximately 4-8 threads, 5-7 threads, 5-6 threads, or otherwise. Finally, without limitation, as few as 5 threads will also provide an adequate interface with an engine head. In addition, while the spark plug is shown to have multiple internal electrodes a single electrode extending a length of the spark plug can also be employed. Furthermore, it should be understood that the above described ranges are only associated with an exemplary embodiment and can vary without departing from the scope of the present invention. Finally, while described in connection with a 12 mm small diameter plug, the present invention could also be employed in 14 mm diameter spark plugs or otherwise. In general, the invention is only intended to be limited by the scope of the following claims.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the present application.

The invention claimed is:

1. A small diameter spark plug comprising:

a metal shell having a main body portion including a first end, a second end and an intermediate section that collectively define an interior cavity, the intermediate section including a first unthreaded zone defining a first diametric portion and a second unthreaded zone adjacent to the first unthreaded zone defining a second diametric portion, the first diametric portion having an inner periphery greater than an inner periphery of the second diametric portion, the metal shell further comprising a threaded zone adjacent to the second unthreaded zone and a fourth unthreaded zone adjacent the threaded zone, the threaded zone defining a third diametric portion having an inner periphery less than the inner periphery of the second diametric portion and the fourth unthreaded zone defining a fourth diametric portion having an inner periphery, the inner periphery of the fourth diametric portion being less than the inner periphery of the third diametric portion, wherein the interior cavity has a stepped configuration defined by the inner periphery of the first, second, third and fourth diametric portions;

a ground electrode extending from the fourth diametric portion;

an insulator disposed in the metal shell, the insulator having a first end portion extending from the first end portion of the metal shell, a second end portion provided at the second end of the metal shell and an intermediate portion being configured to be recessed within the stepped configuration of the interior cavity and the intermediate portion extending between the first end portion and second end portion, the intermediate portion having a first diametric section nested within the first diametric portion and a second diametric section nested within the second diametric portion and a third diametric section nested with the third diametric portion, the first diametric section having a material thickness greater than a material thickness of the second diametric section;

a center wire disposed within a central bore extending through the insulator from the first end portion to the second end portion of the insulator, the center wire having a head portion positioned within the second diametric section of the insulator; and a resistor disposed in the central bore of the insulator, the resistor being in electrical communication with the center wire via the head portion and the resistor is located within the first diametric section and the second diametric section of the insulator, wherein a minimum thickness of at least 2.0 mm of the insulator is located between the resistor and the first diametric portion and the second diametric portion of the intermediate section of the metal shell and wherein an outer diameter of the threaded zone is no greater than 12 mm.

2. The small diameter spark plug according to claim 1, wherein the first diametric section includes an outer periphery greater than an outer periphery of the second diametric section.

3. The small diameter spark plug according to claim 1, wherein the central bore has an upper portion and a lower portion, the upper portion being larger than the lower portion and wherein the resistor is located in the upper portion of the central bore.

4. The small diameter spark plug according to claim 1, wherein the threaded zone includes 4 to 8 threads.

5. The small diameter spark plug according to claim 1, wherein the threaded zone includes 5 to 7 threads.

6. The small diameter spark plug according to claim 1, wherein the threaded zone includes 5 to 6 threads.

7. The small diameter spark plug according to claim 1, wherein the threaded zone includes 7 threads.

8. The small diameter spark plug according to claim 1, wherein the threaded zone includes 5-15 threads.

9. The small diameter spark plug according to claim 1, wherein a diameter of the resistor is at least 4.0 mm.

10. The small diameter spark plug according to claim 9, wherein the threaded zone includes no more than 7 threads.

11. The small diameter spark plug according to claim 10, wherein the central bore has an upper portion and a lower portion, the upper portion being larger than the lower portion and wherein the resistor is located in the upper portion of the central bore.

12. A small diameter spark plug comprising:

a metal shell having a main body portion including a first end, a second end and an intermediate section that collectively define an interior cavity, the intermediate section including a first unthreaded zone defining a first diametric portion and a second unthreaded zone adjacent to the first unthreaded zone defining a second diametric portion, the first diametric portion having an inner periphery greater than an inner periphery of the second diametric portion, the metal shell further comprising a threaded zone adjacent to the second unthreaded zone and a fourth unthreaded zone adjacent the threaded zone, the threaded zone defining a third diametric portion having an inner periphery less than the inner periphery of the second diametric portion and the fourth unthreaded zone defining a fourth diametric portion having an inner periphery, the inner periphery of the fourth diametric portion being less than the inner periphery of the third diametric portion, wherein the interior cavity has a stepped configuration defined by the inner periphery of the first, second, third and fourth diametric portions;

a ground electrode extending from the fourth diametric portion;

an insulator disposed in the metal shell, the insulator having a first end portion extending from the first end portion of the metal shell, a second end portion extending from the second end of the metal shell and an intermediate portion being configured to be recessed within the stepped configuration of the interior cavity and the intermediate portion extending between the first end portion and second end portion, the intermediate portion having a first diametric section nested within the first diametric portion and a second diametric section nested within the second diametric portion and a third diametric section nested with the third diametric portion, the first diametric section having a material thickness greater than a material thickness of the second diametric section;

a center wire disposed within a central bore extending through the insulator from the first end portion to the second end portion of the insulator, the center wire having a head portion positioned within the second diametric section of the insulator; and a resistor disposed in the central bore of the insulator, the resistor being in electrical communication with the center wire via the head portion and the resistor is located within the first diametric section and the second diametric section of the insulator, wherein a minimum thickness of at least 2.0 mm of the insulator is located between the resistor and the first diametric portion and the second diametric portion of the intermediate section of the metal shell and wherein an outer diameter of the threaded zone is no greater than 12 mm.

13. The small diameter spark plug according to claim 12, wherein a diameter of the resistor is at least 4.0 mm.

14. The small diameter spark plug according to claim 13, wherein the threaded zone includes no more than 7 threads.

15. The small diameter spark plug according to claim 14, wherein the central bore has an upper portion and a lower portion, the upper portion being larger than the lower portion and wherein the resistor is located in the upper portion of the central bore.

* * * * *